United States Patent [19]

Ogden et al.

[11] 4,246,913

[45] Jan. 27, 1981

[54] APPARATUS FOR REDUCING THE DESIRE TO SMOKE

[75] Inventors: Richard G. Ogden; Robert P. Lawrence, both of Los Angeles, Calif.

[73] Assignee: Henry R. Harrison, Tujunga, Calif. ; a part interest

[21] Appl. No.: 25,782

[22] Filed: Apr. 2, 1979

[51] Int. Cl.[3] ..... A24F 7/00; A24F 47/00

[52] U.S. Cl. ..... 131/171 A; 434/236

[58] Field of Search ..... 128/138 A; 35/22 R; 131/170 A, 171 A, 8 A, 9

[56] References Cited

U.S. PATENT DOCUMENTS

| | | | |
|---|---|---|---|
| 3,441,019 | 4/1969 | Snyder | 128/138 A |
| 3,482,580 | 12/1969 | Hollabaugh | 131/171 A |
| 3,696,357 | 10/1972 | Kilgore | 128/138 A |
| 3,885,576 | 5/1975 | Symmes | 131/170 A |
| 3,886,953 | 6/1975 | Pope | 131/170 A |
| 3,889,163 | 6/1975 | Symmes | 131/170 A |
| 3,963,033 | 6/1976 | Pope | 131/170 A |
| 4,068,672 | 1/1978 | Guerra | 131/170 A |
| 4,138,722 | 2/1979 | Bonnett | 131/171 A |

FOREIGN PATENT DOCUMENTS

| | | | |
|---|---|---|---|
| 2747500 | 10/1977 | Fed. Rep. of Germany | 131/170 A |

*Primary Examiner*—V. Millin

*Attorney, Agent, or Firm*—Fulwider, Patton, Rieber, Lee & Utecht

[57] ABSTRACT

A device for use by a smoker in developing a subconscious aversion to smoking. The device includes a special pressure transducer that is coupled to a holder for a smoking article such as a cigarette, for sensing whenever smoke is drawn from the cigarette and for producing a corresponding electrical control signal. The device further includes a transformer for converting the control signal to an electrical shock signal having a substantially higher voltage level, a potentiometer for permitting a manual adjustment of the voltage of the shock signal to a prescribed level, and a pair of electrodes for coupling the shock signal to the skin of the smoker, whereby every time smoke is drawn from the cigarette, a small, but annoying, electrical shock is received by the smoker.

4 Claims, 4 Drawing Figures

APPARATUS FOR REDUCING THE DESIRE TO SMOKE

BACKGROUND OF THE INVENTION

This invention relates generally to devices for use in smoking, and, more particularly, to devices for helping a smoker overcome an habitual desire to smoke.

In recent years, it has become generally known that tobacco smoking has a significant adverse effect on the health of smokers. As a result, many smokers have sought to stop smoking, or at least to reduce substantially the amount they smoke. The addictive nature of tobacco smoking, however, has frequently made this goal difficult to achieve.

Many devices and techniques have been devised to help a smoker reduce the amount of his smoking, but none is believed to have been completely satisfactory. One popular class of devices includes various types of filters to remove portions of the harmful components of tobacco smoke prior to their being inhaled by the smoker. These devices have not proven entirely satisfactory, however, because in removing the harmful components, the devices likewise reduce the degree of satisfaction that the smoker is able to receive. Thus, the user of these devices frequently will smoke a greater amount than he did previously, in order to achieve an equal degree of satisfaction.

Another technique for reducing an habitual desire to smoke, utilizing a psychological approach known as aversion therapy, has been practiced by a number of anti-smoking clinics that have operated in recent years. In one phase of this therapy, a smoker is asked to repeatedly draw smoke from a smoking device such as a cigarette, while simultaneously a skilled technician administers a small, but annoying, electrical shock to his skin. This causes a general feeling of discomfort, which the smoker subconsciously associates with his acts of smoking, thereby developing in him a subconscious aversion to the act of smoking. Although this particular aversion therapy technique has proven effective at reducing the habitual desire of a smoker to smoke, it has not proven entirely satisfactory, primarily because it is generally an expensive procedure, requiring the presence of a skilled technician, and because it generally can be performed only at selected, infrequent times.

It will be appreciated from the foregoing that there is a definite need for a simple, yet effective device that can automatically and contemporaneously produce an annoying effect every time a user draws on a smoking device, whereby a subconscious aversion to the act of smoking can be developed without the need for the presence of a skilled technician. The present invention fulfills this need.

SUMMARY OF THE INVENTION

Basically, the present invention is embodied in a device for helping a smoker develop a subconscious aversion to smoking. In accordance with the invention, the device includes means for sensing whenever smoke is being drawn by a smoker from a smoking article such as a cigarette, and means for automatically producing a contemporaneous effect, such as a small electrical shock, that is annoying to the smoker. Thus, the subconscious aversion to smoking can be developed at any time convenient to the smoker and without the need for a skilled technician to be present.

More particularly, the sensing means of the device includes a pressure transducer that is coupled via a small tube to a holder for the smoking article. The transducer includes a pair of electrical contacts that are spring-biased apart from each other, but that are urged into contact whenever a partial vacuum, due to the drawing of smoke through the cigarette holder, occurs. This produces an electrical control signal that is coupled through a transformer to a pair of spaced electrodes located on a wristband, to provide a small, but annoying, electrical shock to the skin of the smoker. Additionally, the device includes a potentiometer for permitting the smoker to controllably adjust to a desire level the magnitude of the electrical shocks he receives.

Other aspects and advantages of the present invention will become apparent from the following description of the preferred embodiment, taken in conjunction with the accompanying drawings, which disclose, by way of example, the principles of the invention.

DESCRIPTION OF THE PREFERRED EMBODIMENT

Figure 1:
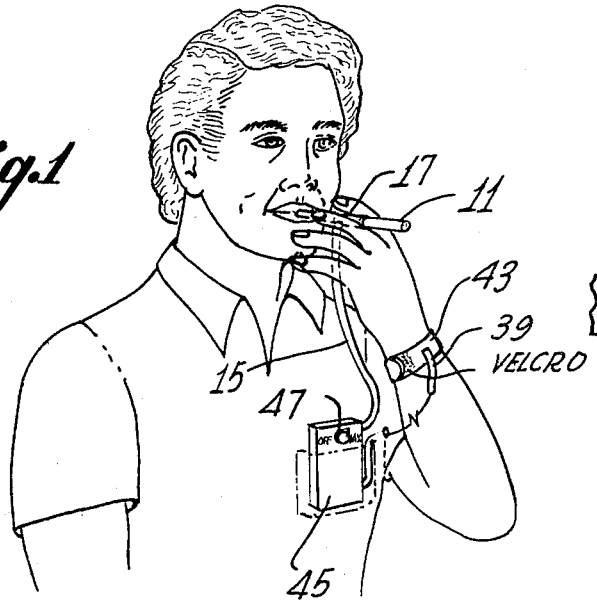
FIG. 1 is a diagram of a device in accordance with the present invention for helping a smoker develop a subconscious aversion to smoking, the device being shown in normal use by a smoker.
Figure 2:
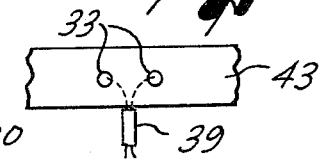
FIG. 2 is a fragmentary plan view of two electrodes on the wristband of the device of FIG. 1.

Referring now to the drawings, and particularly to FIG. 1, there is shown a device for helping a smoker overcome an habitual desire to smoke. The device utilizes principles of aversion therapy, wherein an annoying effect is produced every time the smoker draws smoke from a smoking article, such as a cigarette 11.

In accordance with the invention, the device includes means for sensing the drawing of smoke from the cigarette 11 and for producing a corresponding control signal, along with means, responsive to the control signal, for producing a small, but annoying electrical shock for application to the skin of the smoker. Thus, every time smoke is drawn from the cigarette, the smoker receives a contemporaneous and annoying electrical shock that enables him to develop a subconscious aversion to both the act of smoking and the cigarette itself. The device can be used without the need for the presence of a skilled technician to administer the electrical shock treatment and can be conveniently used by the smoker at almost any time, even when he is involved in other activities.

Figure 3:
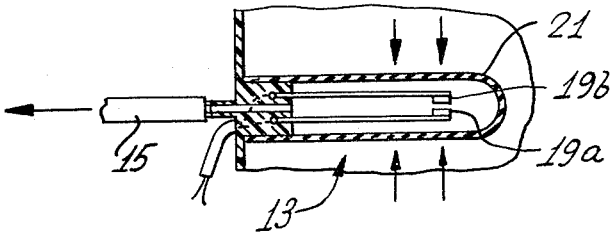
FIG. 3 is a cross-sectional view of a pressure transducer in the device of FIG. 1.

More particularly, and with reference to FIGS. 1 and 3, the device includes a pressure transducer 13 that is coupled through a small-diameter tube 15 to a port in the side of a conventional holder 17 for the cigarette 11. Whenever smoke is drawn from the cigarette, a partial vacuum is produced in the holder and coupled through the tube to the pressure transducer, to close a pair of electrical contacts 19*a* and 19*b* in the transducer. These contacts, which are normally spring-biased apart from each other, are disposed within a resilient diaphragm in the form of a small rubber bag 21, with the region within the bag in communication with the tube 15 and the region outside of the bag ported to the atmosphere.

Thus, when a partial vacuum is created, the bag collapses and the two contacts are urged together.

Figure 4:
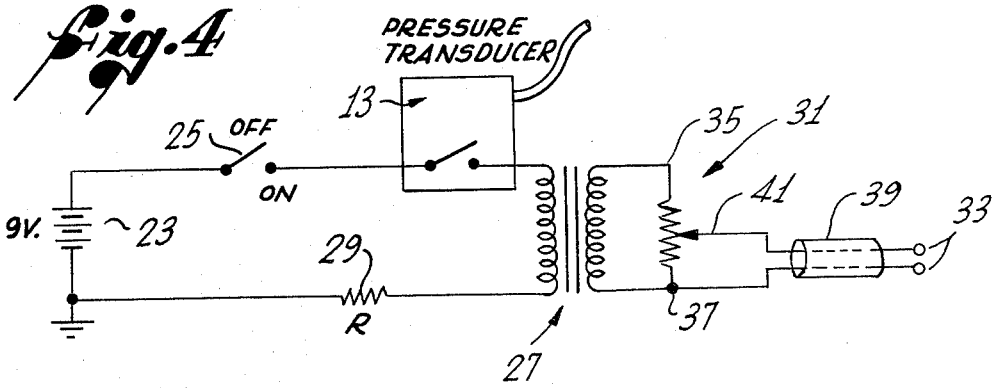
FIG. 4 is a schematic diagram of the electrical circuitry in the device of FIG. 1.

As shown in FIG. 4, the device further includes a battery 23 for providing a 9-volt dc voltage, an on/off switch 25, a transformer 27, and a current-limiting resistor 29, all connected in series with the electrical contacts 19*a* and 19*b* of the pressure transducer 13. As a result, when the on/off switch is closed, a 9-volt control signal is coupled to the primary winding of the transformer every time the two contacts of the pressure transducer are urged into contact with each other. The resistor is included to limit the drain of current on the battery, and the combined resistance of the resistor and the primary winding is preferably about 50 ohms.

The device further includes a potentiometer 31 and a pair of electrodes 33. The two end terminals 35 and 37 of the potentiometer are connected to the two terminals of the secondary winding of the transformer 27, and the pair of electrodes is coupled over a wire pair 39 to the wiper terminal 41 of the potentiometer and one terminal of the secondary winding. In the preferred embodiment, the transformer has a turns ratio of about 1:26, and the potentiometer has a resistance of about 250 kilo-ohms.

The two electrodes 33, which are preferably spaced about 1 to $1\frac{1}{2}$ inches apart from each other, can be conveniently mounted on a wristband 43 that can be secured to the wrist of the smoker by means of a conventional VELCRO strip. Additionally, to facilitate a distribution of current over the entire surface area of each electrode, a small amount of a conventional electrolyte jelly (not shown) can be coated on the electrodes prior to their use.

In operation, with the on/off switch 25 closed, a 9-volt control signal is coupled to the primary winding of the transformer 27 each time the smoker draws smoke from the cigarette 11. This produces a corresponding electrical signal in the secondary winding of the transformer, having a voltage level substantially greater than 9 volts. This latter signal is coupled through the potentiometer 31 to the electrodes 33, to provide an electrical shock to the wrist of the smoker. The potentiometer permits the smoker to controllably adjust the voltage level of the signal coupled to the electrodes, and thus the magnitude of the electrical shock. Ordinarily, the voltage should be adjusted to a level that just exceeds the minimum level of sensation for the smoker.

The portion of the device depicted in FIG. 4 can be conveniently housed in a box 45 that is sufficiently small to be carried in a shirt pocket, as shown in FIG. 1. Additionally, the on/off switch 25 and the potentiometer 31 can be combined in a single element having just a single control knob 47 (FIG. 1) disposed on the outside of the box.

From the foregoing description, it should be apparent that the present invention provides an effective device for reducing, and even eliminating, the desire to smoke by sensing the drawing of smoke from a cigarette and for automatically and contemporaneously producing a small, but annoying, electrical shock for application to the skin of the smoker.

Although the invention has been described in detail with reference to its presently preferred embodiment, it will be understood by one of ordinary skill in the art that various modifications can be made without departing from the spirit and scope of the invention. Accordingly, it is not intended that the invention be limited, except as by the appended claims.

We claim:

1. A device for use by a smoker in reducing the desire to draw smoke from a smoking article, comprising:

means for sensing the drawing of smoke from a smoking article, and for producing a corresponding electrical control signal, said sensing means including means for holding the smoking article and for creating a partial vacuum whenever smoke is drawn therethrough, and pressure transducer means, coupled to said holding means, for sensing the presence of the partial vacuum therein and producing the control signal;

an electrical transformer for converting the control signal into an electrical shock signal, said electrical shock signal having a voltage level higher than that of the control signal;

a potentiometer for permitting a manual adjustment of the voltage level of the electrical shock signal to a prescribed level;

a pair of electrodes for engagement with the skin of a smoker; and means for coupling the electrical shock signal to said pair of electrodes, whereby an electrical shock is administered to the skin of the smoker whenever smoke is drawn from the smoking article.

2. A device as defined in claim 1, wherein said pressure transducer means includes:

first and second electrical contacts spring-biased apart from each other; and a resilient diaphragm that is movable in response to the partial vacuum to urge said first and second electrical contacts into contact with each other.

3. A device for use by a smoker in reducing the desire to draw smoke from a smoking article, comprising:

means for sensing the drawing of smoke by a smoker from a smoking article, and for producing a corresponding control signal, said sensing means including:

means for holding the smoking article and for creating a partial vacuum whenever smoke is drawn therethrough, and pressure transducer means, coupled to said holding means, for sensing the presence of a partial vacuum therein and producing the corresponding control signal, whereby said pressure transducer means produces the control signal whenever smoke is drawn through said holding means; and signal means, reponsive to the control signal, for automatically and contemporaneously producing an effect that is annoying to the smoker, whereby the smoker develops a subconscious aversion to smoking.

4. A device as defined in claim 3, wherein said pressure transducer means includes:

first and second electrical contacts spring-biased apart from each other; and a resilient diaphragm that is movable in response to a partial vacuum to urge said first and second electrical contacts into contact with each other.

* * * * *